US009913544B1

(12) United States Patent
Weinschreider

(10) Patent No.: US 9,913,544 B1
(45) Date of Patent: Mar. 13, 2018

(54) ELEVATING BED ASSEMBLY AND COMPONENTS THEREOF

(71) Applicant: SleepSafe Beds, LLC, Bassett, VA (US)

(72) Inventor: Gregg Weinschreider, Rocky Mount, VA (US)

(73) Assignee: SLEEPSAFE BEDS, LLC, Bassett, VA (US)

( * ) Notice: Subject to any disclaimer, the term of this patent is extended or adjusted under 35 U.S.C. 154(b) by 311 days.

(21) Appl. No.: 14/853,122

(22) Filed: Sep. 14, 2015

(51) Int. Cl.

| | |
|---|---|
| ***A47C 19/02*** | (2006.01) |
| ***A47C 20/02*** | (2006.01) |
| ***A47C 19/04*** | (2006.01) |
| ***A61G 7/012*** | (2006.01) |

(52) U.S. Cl.
CPC ..... *A47C 19/045* (2013.01); *A47C 19/02* (2013.01); *A47C 19/022* (2013.01); *A47C 19/024* (2013.01); *A61G 7/012* (2013.01)

(58) Field of Classification Search
CPC ..... A47C 19/02; A47C 19/024; A47C 19/021; A47C 19/028; A47C 19/128; A47C 20/021; A47C 17/68; A47C 17/705
See application file for complete search history.

(56) References Cited

U.S. PATENT DOCUMENTS

| | | | | |
|---|---|---|---|---|
| 6,209,157 | B1 | 4/2001 | Hensley | |
| 6,516,478 | B2 | 12/2003 | Cook et al. | |
| 6,694,549 | B2 | 2/2004 | Perez et al. | |
| 7,690,058 | B1 * | 4/2010 | Dwyer | A47C 19/005 5/200.1 |
| 8,261,381 | B2 | 9/2012 | Hallock et al. | |
| 8,646,132 | B2 | 2/2014 | Nguyen | |
| 2006/0026754 | A1 * | 2/2006 | Ward, Jr. | A47C 19/005 5/9.1 |

* cited by examiner

*Primary Examiner* — David E Sosnowski
*Assistant Examiner* — Rahib T Zaman
(74) *Attorney, Agent, or Firm* — Charles S. Sara; DeWitt Ross & Stevens S.C.

(57) ABSTRACT

Components and assemblies for elevating beds and other items supported on a solid surface. An elevating bed assembly is provided that permits attaching a headboard and/or footboard to an elevating portion of a bed while maintaining the headboard and/or footboard in an upright position in contact with the floor. A leg mount system is provided that permits attaching a variety support legs having different shapes and sizes to a single frame without modifying the frame.

10 Claims, 16 Drawing Sheets

ELEVATING BED ASSEMBLY AND COMPONENTS THEREOF

FIELD OF THE INVENTION

The invention is directed to components for beds, elevating beds, and other types of floor-stabilized furniture or appliances, as well as assemblies of such components.

BACKGROUND

Elevating or height-adjustable beds are used frequently in hospitals, nursing homes, and many non-clinical settings. However, conventional elevating bed designs have unique challenges in connecting to standard headboards while maintaining the headboards in an upright position. Some designs immovably attach the headboard directly to an elevating portion of the bed. See, e.g., U.S. Pat. No. 6,694,549. This provides a simple attachment mechanism but is unacceptable if maintaining the headboard in contact with the floor is desired. Other designs immovably attach the headboard directly to a non-elevating, floor-supported portion of the bed. See, e.g., U.S. Pat. Nos. 6,209,157; 6,516,478; 6,694,549; 8,261,381; and 8,646,132. However, these designs typically employ complicated, cumbersome, or specialized linkage mechanisms, require sideboards and footboards to support the headboard, require the use of specialized headboards, and/or severely limit the interchangeability of one headboard with another. An elevating bed assembly that permits simple attachment of a headboard to an elevating portion of a bed while maintaining the headboard in an upright position in contact with the floor is needed.

Another challenge with conventional elevating bed designs is that extendable support legs for raising and lowering the frame are typically different in structure than standard, non-elevating support legs, thereby requiring differently structured frames. A leg mount system that permits attachment of a variety support legs having different shapes and sizes to a single frame without modifying the frame is needed.

SUMMARY OF THE INVENTION

The present invention provides an elevating bed assembly that permits attaching a headboard to an elevating portion of a bed while maintaining the headboard in an upright position in contact with the floor.

An exemplary elevating bed assembly comprises a frame, an elevating floor support, a headboard, and a translational connector. The frame provides a rigid structure within a plane spanning a longitudinal dimension and an orthogonal lateral dimension. The elevating floor support is attached to the frame and is capable of raising and lowering the frame within a vertical dimension orthogonal to the longitudinal and lateral dimensions without pitching or rolling the frame with respect to the plane. The headboard comprises a headboard floor support independent of the elevating floor support. The translational connector connects the headboard to the frame. The translational connector comprises a first connector element and a second connector element. The first connector element is translationally moveable with respect to the second connector element in the vertical dimension.

In some versions of the elevating bed assembly, the first connector element is freely movable with respect to the second connector element in the vertical dimension.

In some versions of the elevating bed assembly, the first connector element is substantially translationally immoveable with respect to the second connector element in a dimension selected from the group consisting of the longitudinal dimension and the lateral dimension.

In some versions of the elevating bed assembly, the first connector element is substantially rotationally immoveable about a dimension selected from the group consisting of the longitudinal dimension, the lateral dimension, and the vertical dimension.

In some versions of the elevating bed assembly, the first connector element is slidable with respect to the second connector element.

In some versions of the elevating bed assembly, the first connector element comprises a track extended in the vertical dimension and the second connector element slidably attaches to the track.

In some versions of the elevating bed assembly, the first connector element comprises a track extended in the vertical dimension, the second connector element comprises a foot slidably attachable to the track, and the foot spans a distance of at least 3 cm in the vertical dimension and a distance of at least 1.5 cm in the lateral dimension.

In some versions of the elevating bed assembly, the first connector element comprises a track extended in the vertical dimension, the track comprises a groove extending at least a portion of the track in the vertical dimension, and the second connector element slidably inserts within the groove.

In some versions of the elevating bed assembly, the groove of the first connector element comprises a substantially "T"-shaped groove as viewed along the vertical dimension. The second connector element comprises a foot and an arm. The foot is in the form of a plate extending in a plane in the vertical dimension and the lateral dimension. The arm extends from a middle portion of the foot between lateral ends of the foot. The foot slidably inserts within the substantially "T"-shaped groove.

In some versions of the elevating bed assembly, support of the headboard with respect to the frame in a parameter selected from the group consisting of translational immovability in the longitudinal dimension, translational immovability in the lateral dimension, rotational immovability about the longitudinal dimension, rotational immovability about the lateral dimension, and rotational immovability about the vertical dimension is provided solely and exclusively by the translational connector.

In some versions of the elevating bed assembly, the translational connector comprises a plurality of translational connectors.

In some versions of the elevating bed assembly, the elevating bed assembly further includes a footboard comprising a footboard floor support independent of the elevating floor support and further independent of the headboard floor support. The footboard is connected to the frame via an additional translational connector comprising a third connector element and a fourth connector element. The third connector element is translationally moveable with respect to the fourth connector element in the vertical dimension. In some versions of the elevating bed assembly, the footboard is connected to the headboard only via the frame.

In some versions of the elevating bed assembly, the frame comprises a plurality of bars spanning the frame in the longitudinal dimension and a plurality of bars spanning the frame in the lateral dimension.

In some versions of the elevating bed assembly, the elevating floor support comprises a leg mount. The leg mount comprises a leg mount cover, a stabilizer block, and an extendable support leg. The leg mount cover comprises a first side panel, a second side panel, and an upper horizontal panel. The first and second side panels are connected together and are oriented substantially orthogonally with respect to each other. The upper horizontal panel is connected to the first side panel independently of the second side panel, connected to the second side panel independently of the first side panel, and oriented substantially orthogonally with respect to both the first side panel and the second side panel. The stabilizer block is removably affixable to the leg mount cover via the first side panel and the second side panel. The stabilizer block comprises a channel running therethrough. The channel is positioned with respect to the upper horizontal panel when the stabilizer block is affixed to the leg mount cover such that a support leg running lengthwise along a line substantially orthogonal to the upper horizontal panel can extend through the channel. The extendable support leg is connected to the upper horizontal panel and extends through the stabilizer block affixed to the leg mount cover.

The present invention also provides a leg mount that permits attaching a variety of support legs having different shapes and sizes to a single frame without modifying the frame.

An exemplary leg mount comprises a leg mount cover and stabilizer block. The leg mount cover comprises a first side panel, a second side panel, and an upper horizontal panel. The first and second side panels are connected together and are oriented substantially orthogonally with respect to each other. The upper horizontal panel is connected to the first side panel independently of the second side panel, connected to the second side panel independently of the first side panel, and oriented substantially orthogonally with respect to both the first side panel and the second side panel. The stabilizer block is removably affixable to the leg mount cover via the first side panel and the second side panel. The stabilizer block comprises a channel running therethrough. The channel is positioned with respect to the upper horizontal panel when the stabilizer block is affixed to the leg mount cover such that a support leg running lengthwise along a line substantially orthogonal to the upper horizontal panel can extend through the channel.

In some versions of the leg mount, each of the first side panel and the second side panel comprises a top edge, a bottom edge, and an inner edge. The first side panel is connected to the second side panel via the respective inner edges. A length of each bottom edge is no greater than 0.8 times a length of the top edge on the same panel.

In some versions of the leg mount, each of the first side panel and the second side panel comprises a top edge, an inner edge, and a connecting edge. The first side panel is connected to the second side panel via the respective inner edges. The connecting edge is oriented between 0° and 90° with respect to each of the top edge and the inner edge.

In some versions of the leg mount, each of the first side panel and the second side panel comprises a connecting-edge panel folded from each of the first side panel and the second side panel at the connecting edge on each panel at an angle of at least about 90° with respect to the respective first side panel and second side panel.

In some versions of the leg mount, each of the first side panel and the second side panel comprises a top edge, a bottom edge, an inner edge, an outer edge, and a connecting edge. The first side panel is connected to the second side panel via the respective inner edges. Each bottom edge opposes the top edge on the same panel, is substantially parallel to the top edge on the same panel, and has a length no greater than about 0.8 times a length of the top edge on the same panel. Each outer edge opposes the inner edge on the same panel, is substantially parallel to the inner edge on the same panel, and has a length no greater than about 0.8 times a length of the inner edge on the same panel. Each connecting edge spans from the outer edge to the bottom edge on the same panel.

In some versions of the leg mount, the leg mount cover further comprises spacer panels disposed between the first side panel and the second side panel and between the top panel and each of the first side panel and second side panel.

In some versions of the leg mount, the leg mount cover further comprises a lower horizontal panel. The lower horizontal panel is oriented substantially orthogonally with respect to both the first side panel and the second side panel. The lower horizontal panel extends from the first side panel or the second side panel no further than a distance about 0.75 times a furthest distance the upper horizontal panel extends from the same panel.

In some versions of the leg mount, the first side panel, the second side panel, and the upper horizontal panel are all formed by a single piece of folded material.

In some versions of the leg mount, the stabilizer block comprises a first surface and a second surface. The first surface abuts the first side panel and the second surface abuts the second side panel when the stabilizer block is affixed to the leg mount cover.

In some versions of the leg mount, the leg mount cover further comprises a lower horizontal panel. The lower horizontal panel is oriented substantially orthogonally with respect to both the first side panel and the second side panel. The lower horizontal panel extends from the first side panel or the second side panel no further than a distance about 0.75 times a furthest distance the upper horizontal panel extends from the same panel. The stabilizer block comprises a horizontal surface that abuts the lower horizontal panel when the stabilizer block is affixed to the leg mount cover.

In some versions of the leg mount, the stabilizer block comprises a plurality of stabilizer blocks. The channel of at least one of the plurality of stabilizer blocks differs from the channel of another of the plurality of stabilizer blocks by a characteristic selected from the group consisting of size and shape.

The objects and advantages of the invention will appear more fully from the following detailed description of the preferred embodiment of the invention made in conjunction with the accompanying drawings.

BRIEF DESCRIPTION OF THE DRAWINGS

FIG. 1A shows the elevating bed assembly with the frame in a lowered position. FIG. 1B shows the elevating bed assembly with the frame in a raised position.

FIG. 2A shows a perspective view. FIG. 2B shows a top plan view.

FIG. 3A shows a front perspective view. FIG. 1B shows a side/rear perspective view. FIG. 3C shows a front elevation view. FIG. 3D shows a rear elevation view. FIG. 3E shows a top plan view. FIG. 3F shows a bottom plan view. FIG. 3G shows a side/front elevation view.

FIG. 4A shows a front perspective view. FIG. 4B shows a top plan view. FIG. 4C shows a bottom plan view.

FIG. 5A shows a front perspective view. FIG. 5B shows a bottom plan view.

FIG. 6A shows a side/rear perspective view. FIG. 6B shows a rear elevation view with the stabilizer block and support leg in phantom. FIG. 6C shows a front perspective view with the frame and the support leg in phantom.

DETAILED DESCRIPTION OF THE INVENTION

Figure 1A:
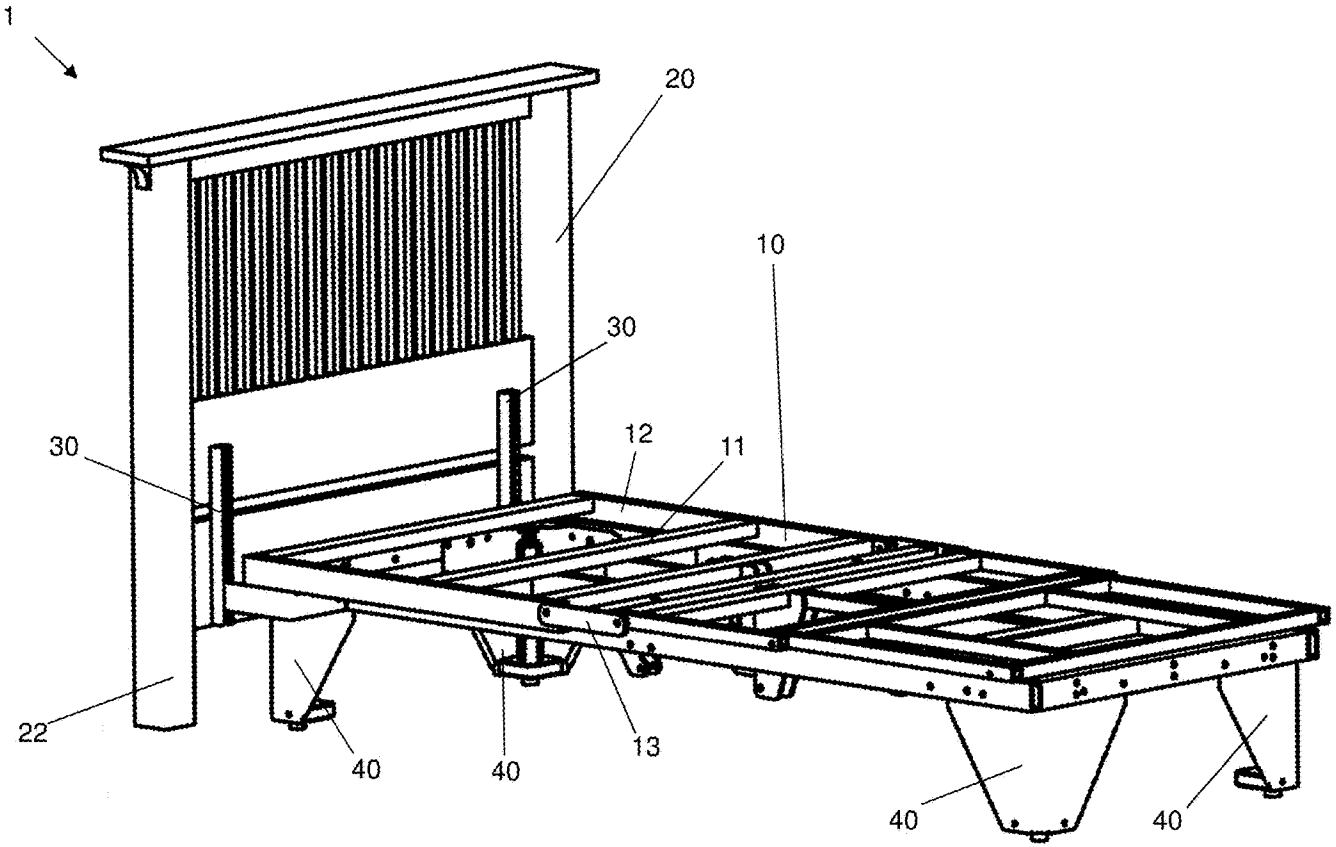
FIGS. 1A and 1B show perspective views of an elevating bed assembly of the present invention.
Figure 1B:
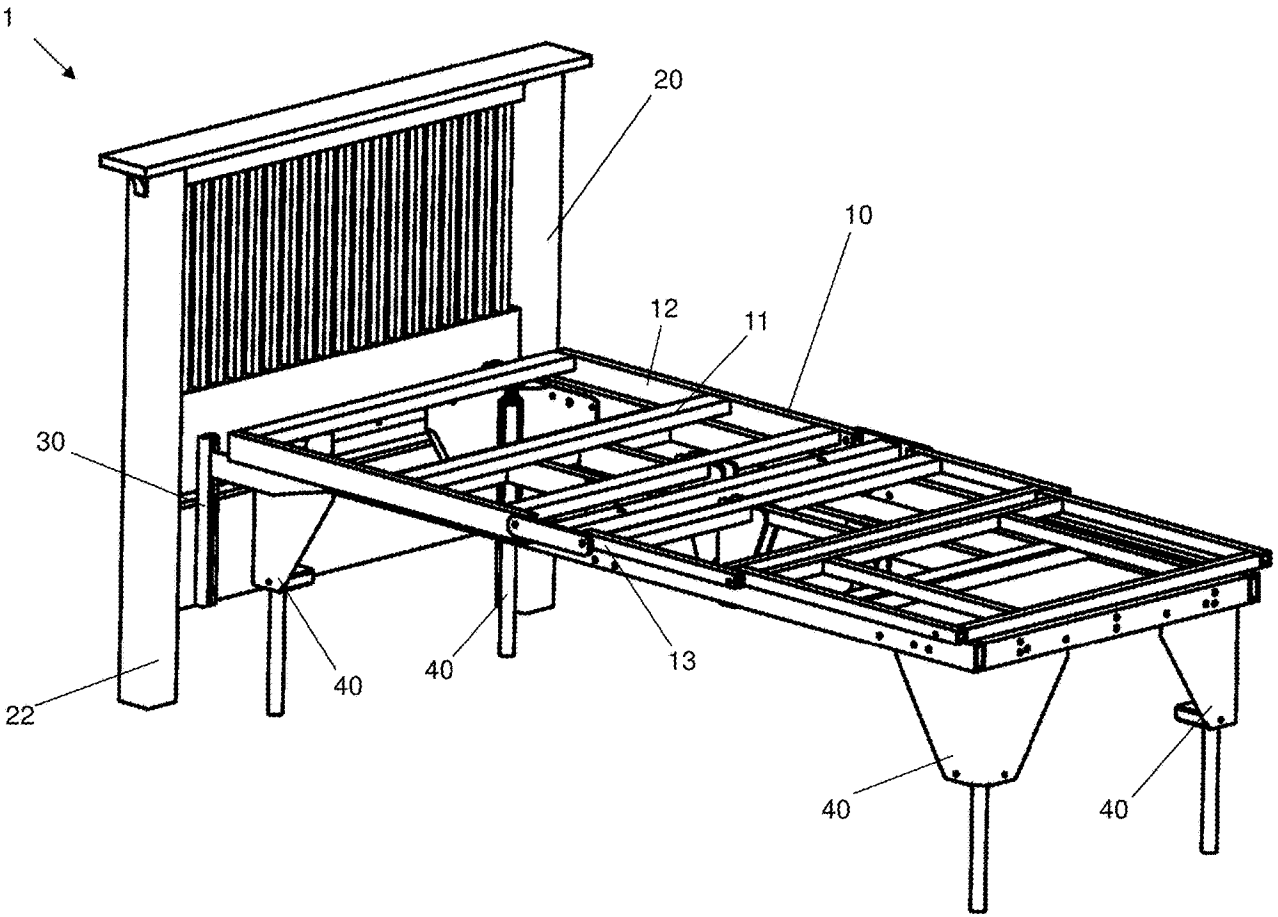

An exemplary elevating bed assembly 1 of the present invention is shown in FIGS. 1A and 1B. FIG. 1A shows the elevating bed assembly 1 in a lowered position. FIG. 1B shows the elevating bed assembly 1 in a raised position. The exemplary elevating bed assembly 1 includes a frame 10 connected to a headboard 20 via translational connectors 30 and elevating floor supports 40 connected to the frame 10.

The frame 10 comprises a plurality of laterally oriented bars 11 rigidly connected to a plurality of longitudinally oriented bars 12 in a substantially rectangular configuration. This configuration forms a rigid structure within a plane spanning a longitudinal dimension and a lateral dimension orthogonal to the longitudinal dimension. Such a structure can be accomplished by any of a number of frame configurations, such as a single rectangular platform, cross-hatched lattice, diagonally oriented bars, an open rectangular bar configuration, etc. The frame 10 may optionally comprise elements 13 to articulate a mattress out of the plane spanning the longitudinal and lateral dimensions. Such elements are well-known in the art. See, e.g., U.S. Pat. Nos. 6,209,157; 6,516,478; 6,694,549; and 8,261,381.

The elevating floor supports 40 connect to the frame 10; support the frame 10, either directly or indirectly, on the floor; and are configured to adjust the effective distance between the frame 10 and the floor. The placement of elevating floor supports 40 on each corner of the frame 10 permits raising and lowering the frame in a vertical dimension orthogonal to the longitudinal and lateral dimensions without pitching or rolling the frame with respect to the plane. "Pitching" refers to rotation of a plane about an axis in the lateral dimension, as would occur in tipping the frame 10 from head-to-toe (i.e., tipping the headboard-end of the frame with respect to the opposing end of the frame). "Rolling" refers to rotation of a plane about an axis in the longitudinal dimension, as would occur in tipping the frame 10 from side-to-side.

The exemplary elevating floor supports 40 comprise a leg mount 100 of the present invention with a telescoping support leg 110 mounted therein (see FIGS. 3A-6C and description below). An exemplary telescoping support leg 110 is a TA19 linear actuator (TA19-5036-001, TiMOTION Technology, New Taipei City, Taiwan). However, any device capable of connecting to the frame 10, supporting the frame 10 on the floor, and adjusting the effective distance between the frame 10 and the floor can serve as a suitable elevating floor support 40. The elevating floor supports can, without limitation, be electrically actuated or manually actuated, be pneumatically actuated or mechanically actuated, and/or can comprise a telescoping support, a scissors linkage, or a hinged-lever linkage. Telescoping supports can comprise screw-extendable legs, ball-detent-adjustable legs, etc. Exemplary extendable devices comprising telescoping, scissors-type, or hinged-lever-type elements are found in U.S. Pat. Nos. 6,209,157; 6,516,478; 6,694,549; 8,261,381; and 8,646,132.

The headboard 20 comprises headboard floor supports 22 that vertically support the headboard, either directly or indirectly, on the floor. The headboard floor supports 22 are distinct from—and independent of—the elevating floor supports 40 on the frame 10. The headboard floor supports 22 thus vertically support the headboard 20 independently of any connection to the frame 10 or the elevating floor supports 40 attached thereto. The term "headboard" is used herein in a manner as understood in the art and generally includes, without limitation, any solid, vertically and laterally extended element disposed at an end of a bed frame, box spring, and/or mattress. Suitable headboards may be made of wood, metal, or any other solid material, and may comprise or consist of platforms, planks, upholstery, bars, etc.

Figure 2A:
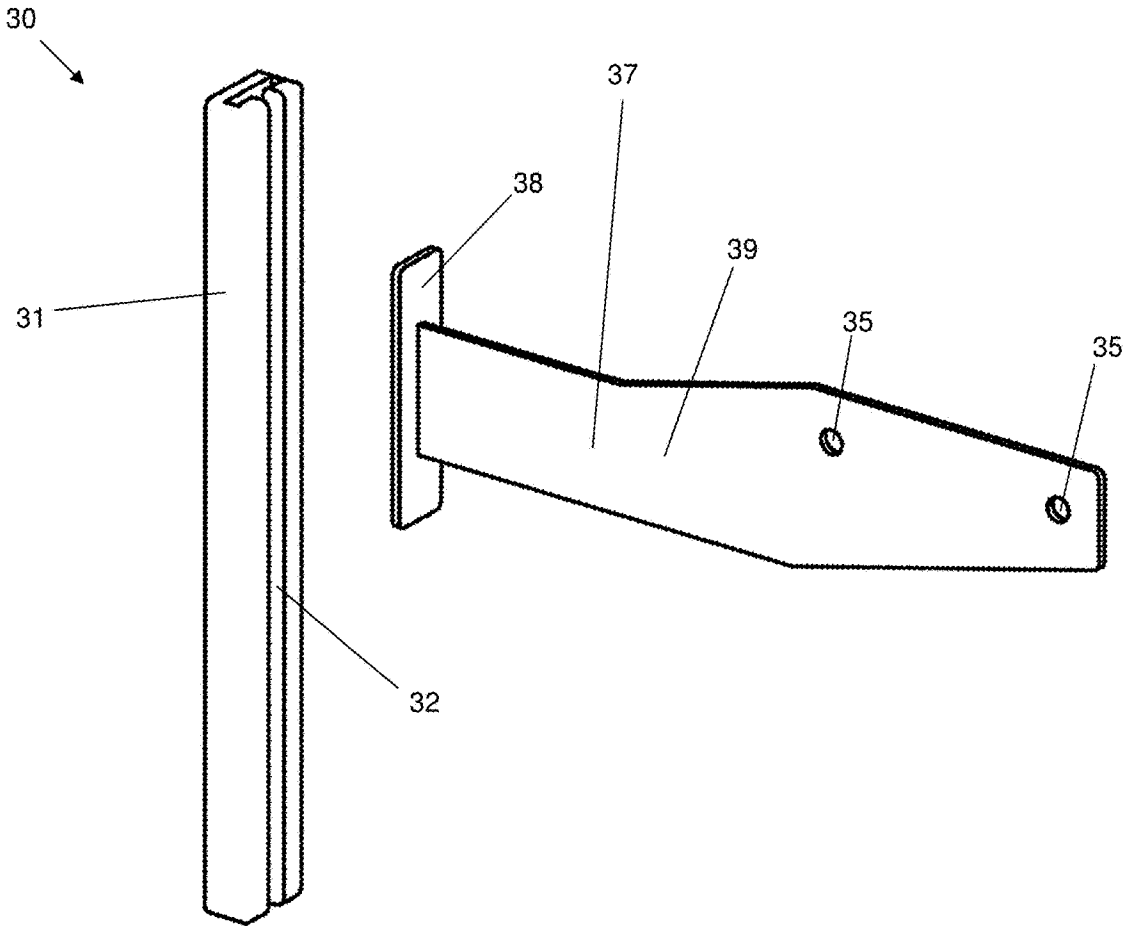
FIGS. 2A and 2B show exploded views of a translational connector of the present invention.
Figure 2B:
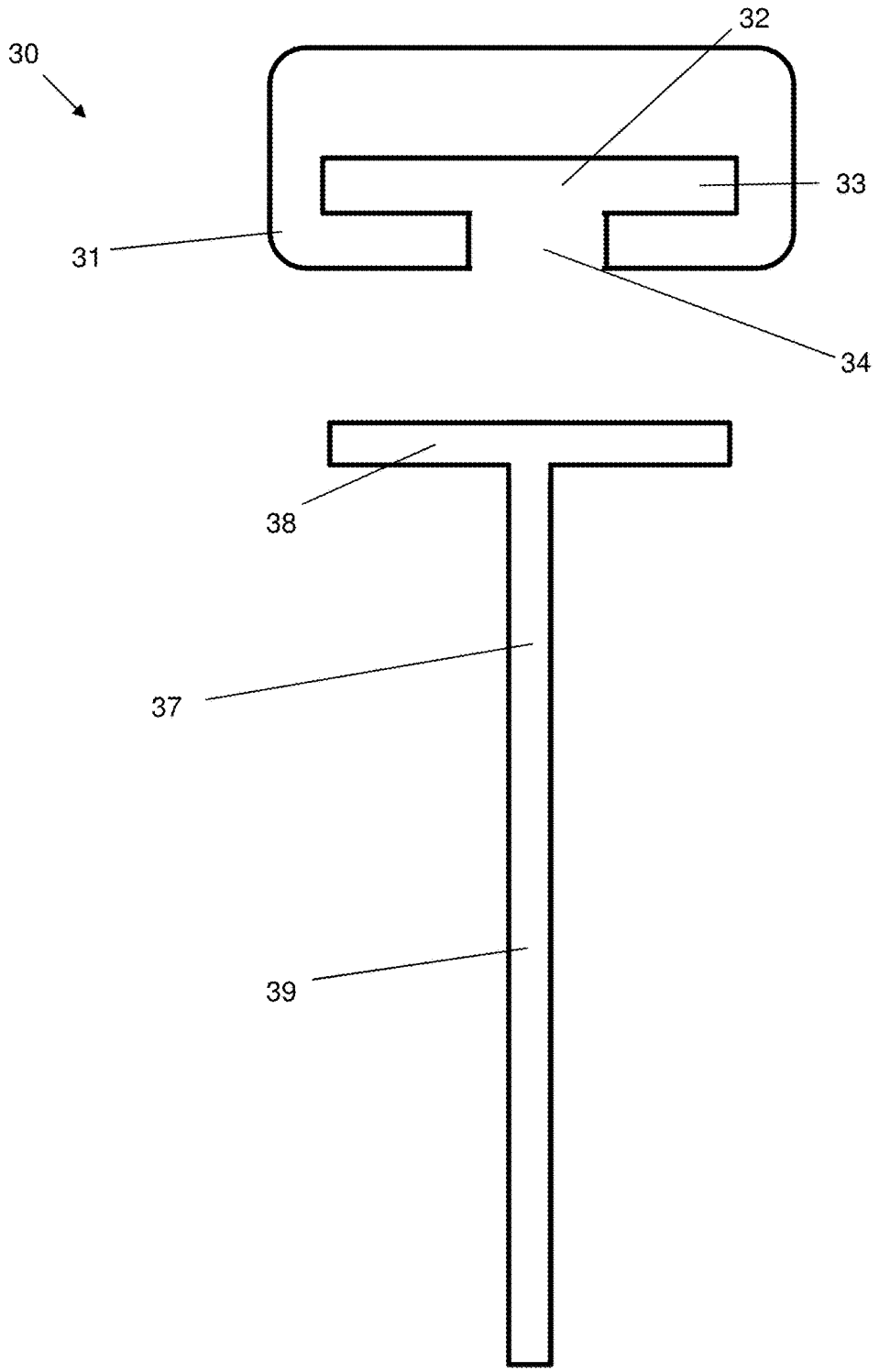
Figure 3A:
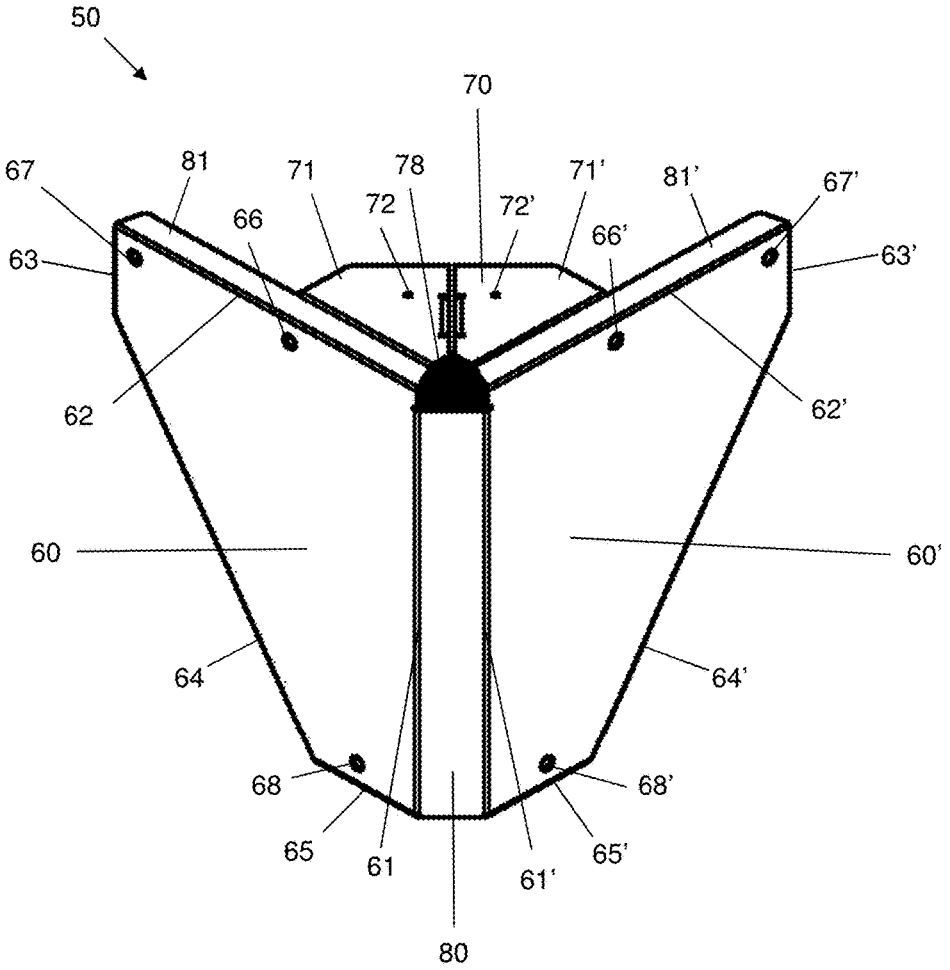
FIGS. 3A-3G show various views of a leg mount cover of the present invention.
Figure 3B:
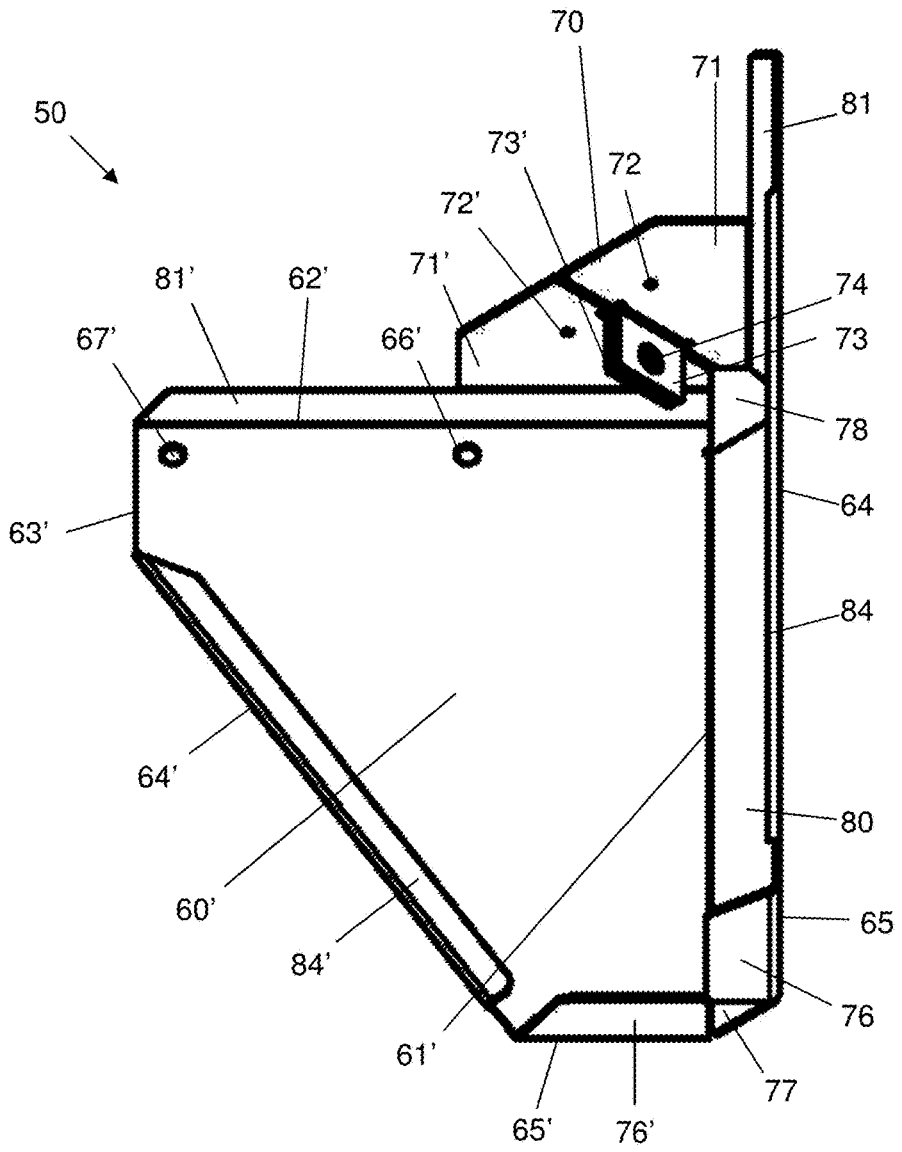
Figure 3C:
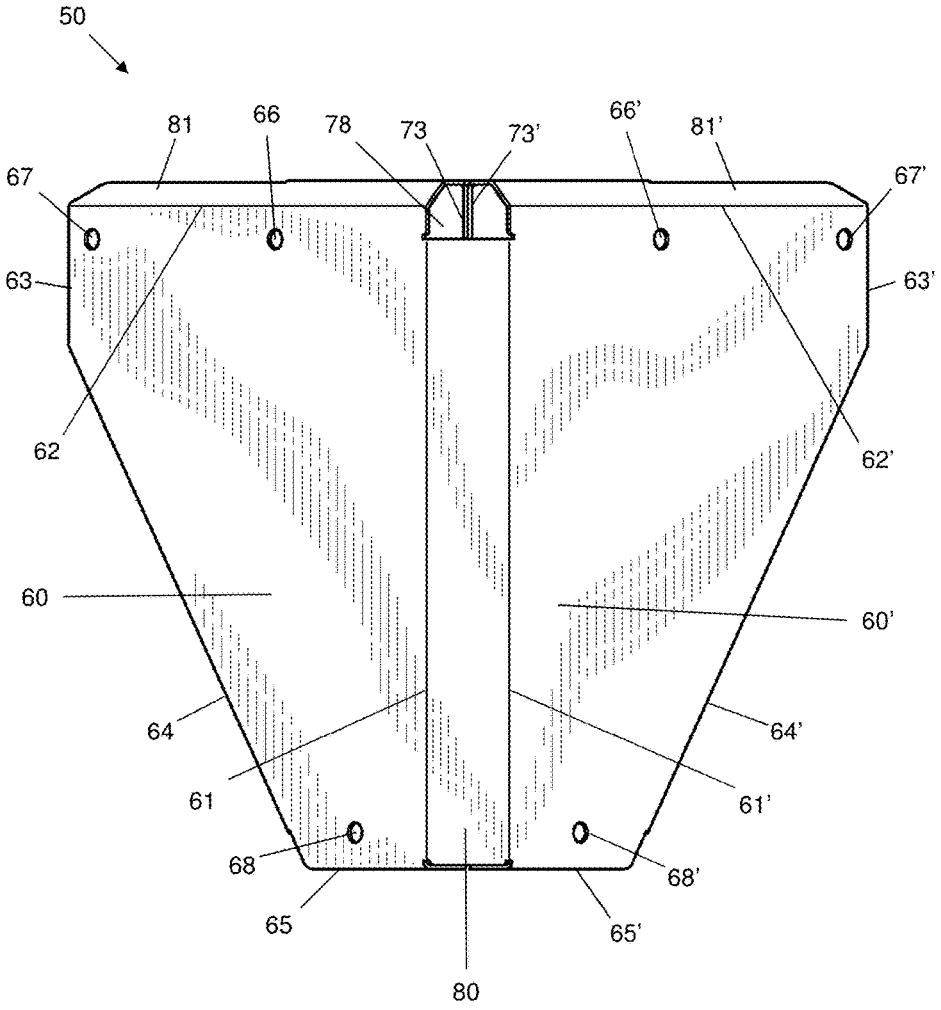
Figure 3D:
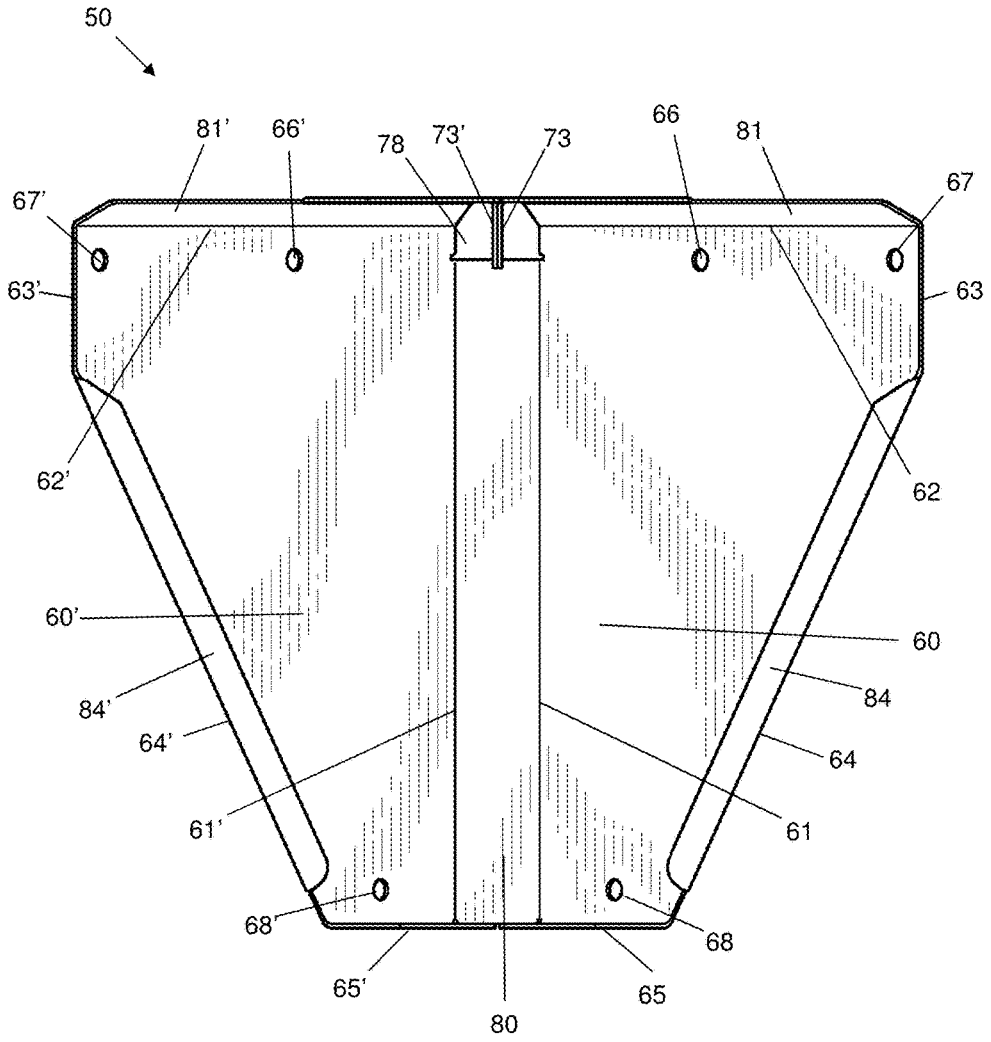
Figure 3E:
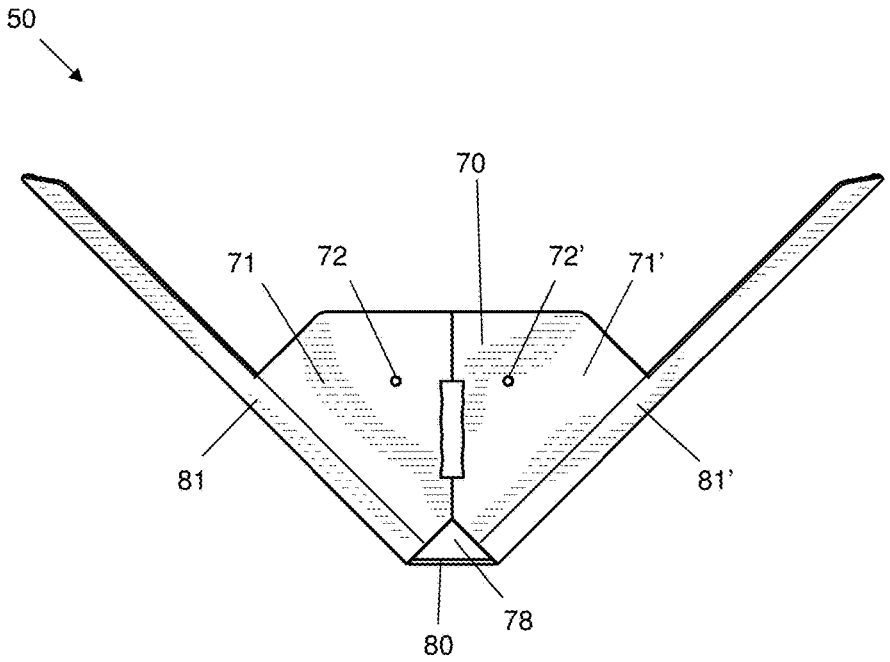
Figure 3F:
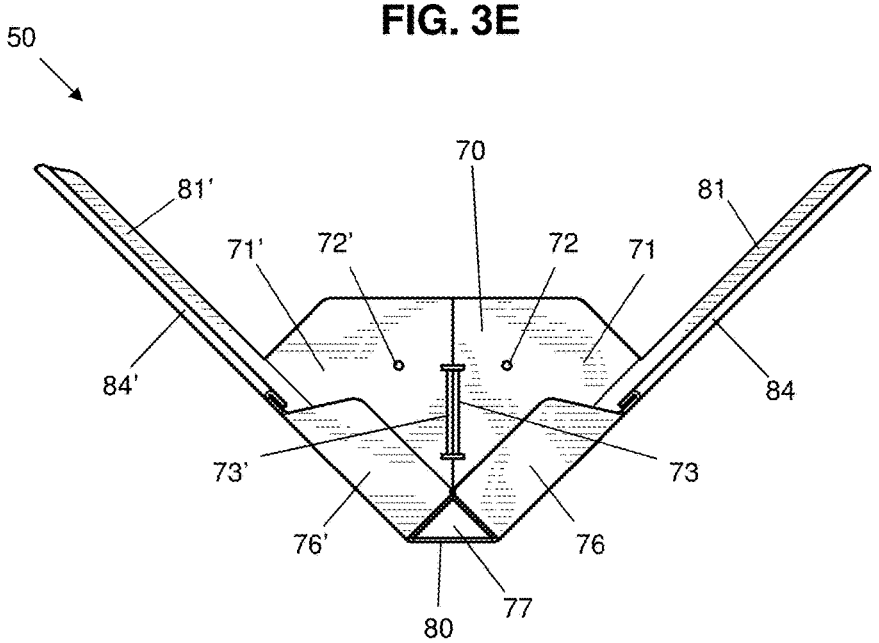
Figure 3G:
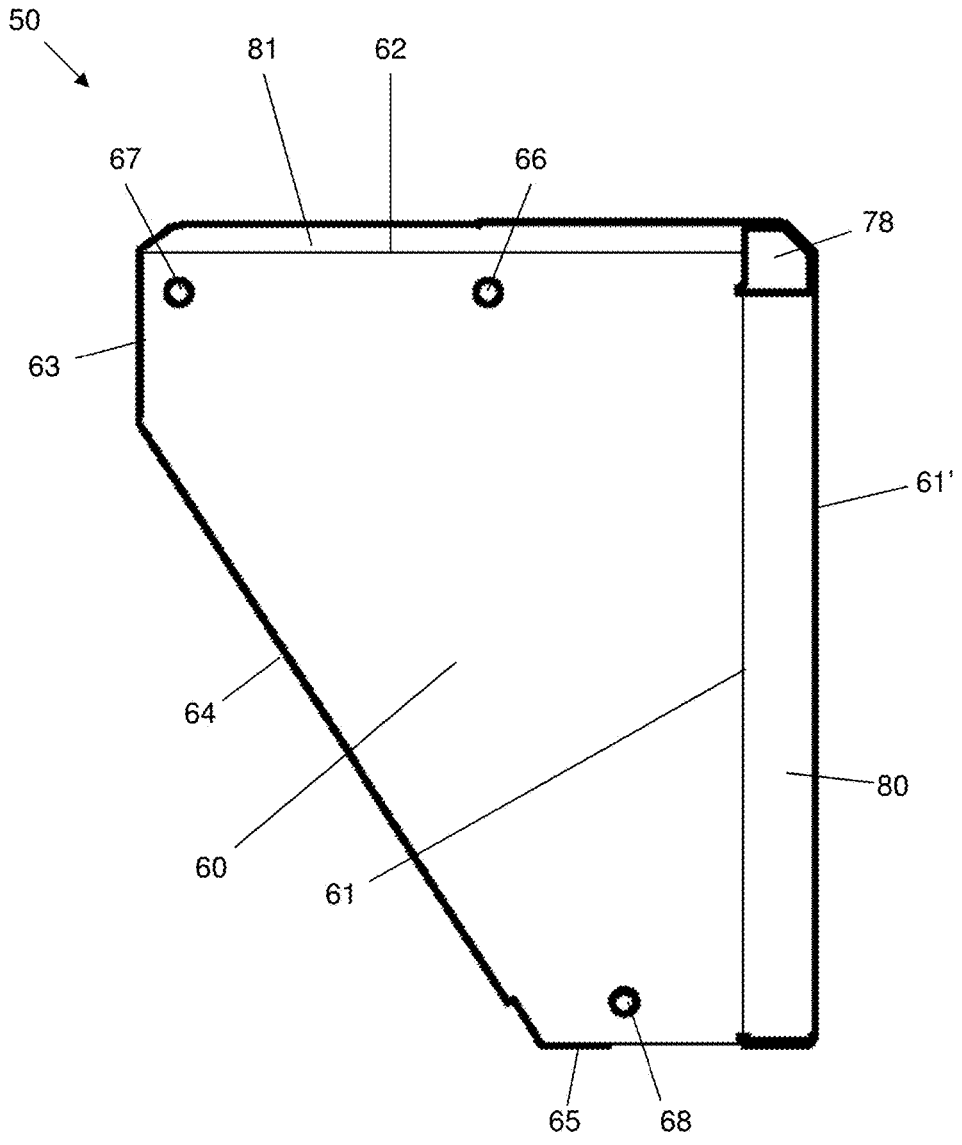
Figure 4A:
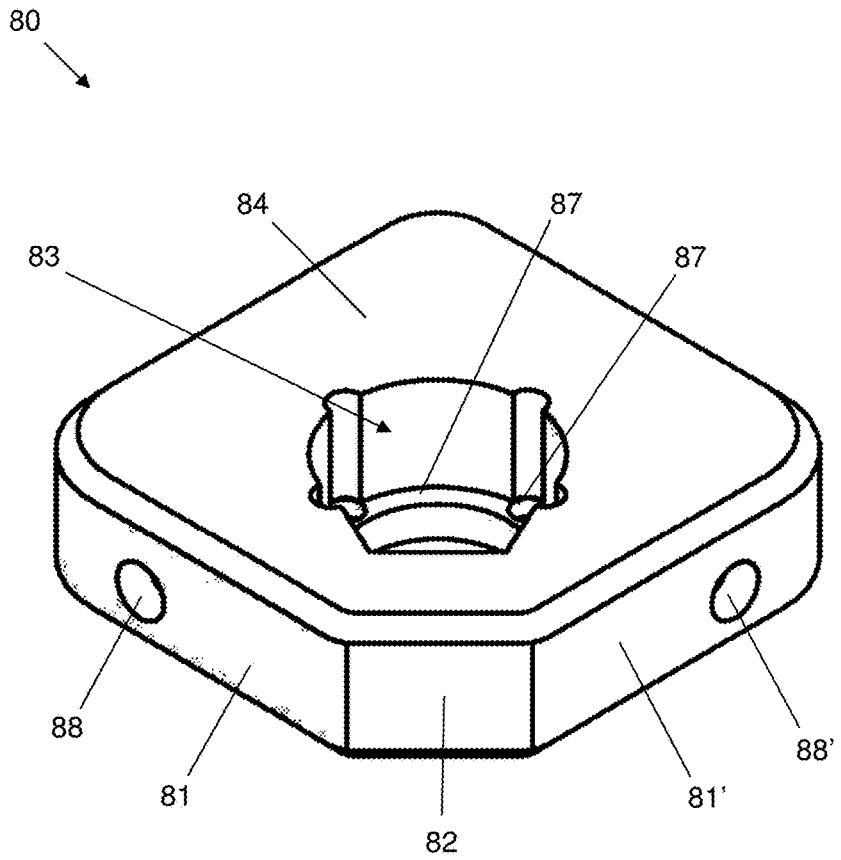
FIGS. 4A-4C show various views of a first exemplary stabilizer block of the present invention.
Figure 4B:
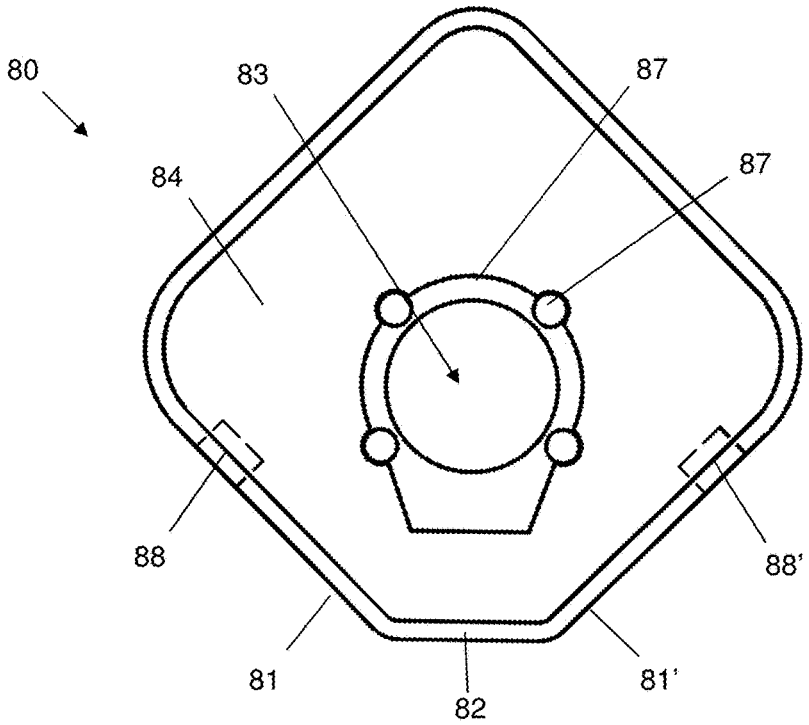
Figure 4C:
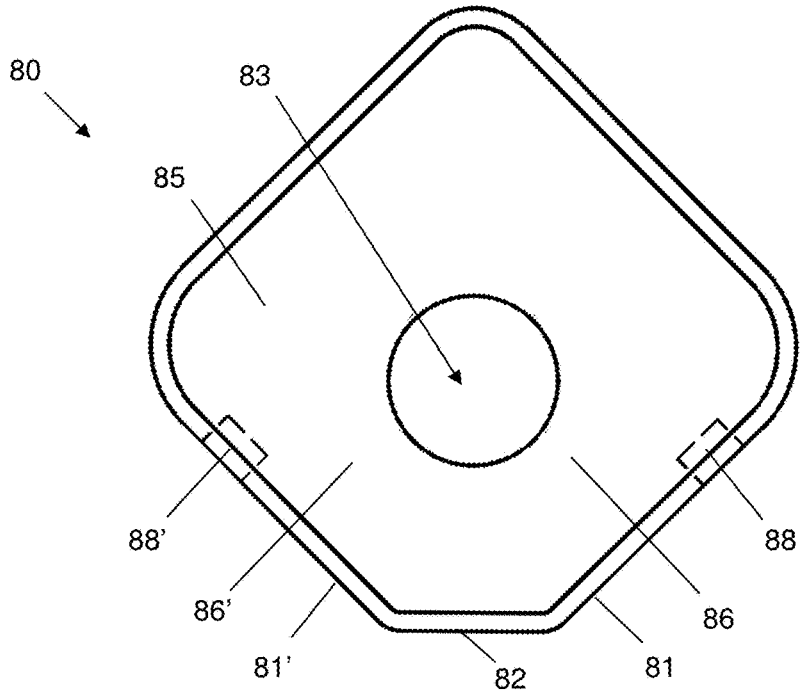
Figure 5A:
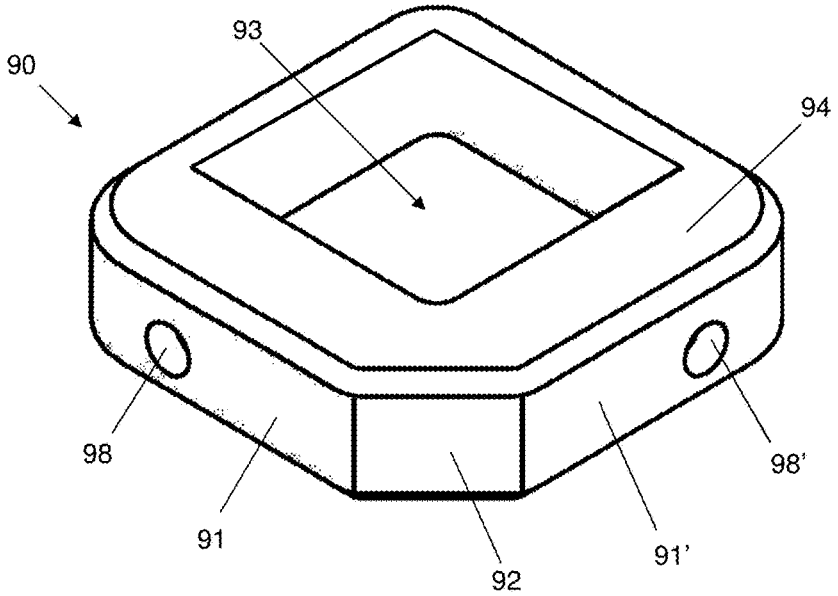
FIGS. 5A and 5B show various views of a second exemplary stabilizer block of the present invention.
Figure 5B:
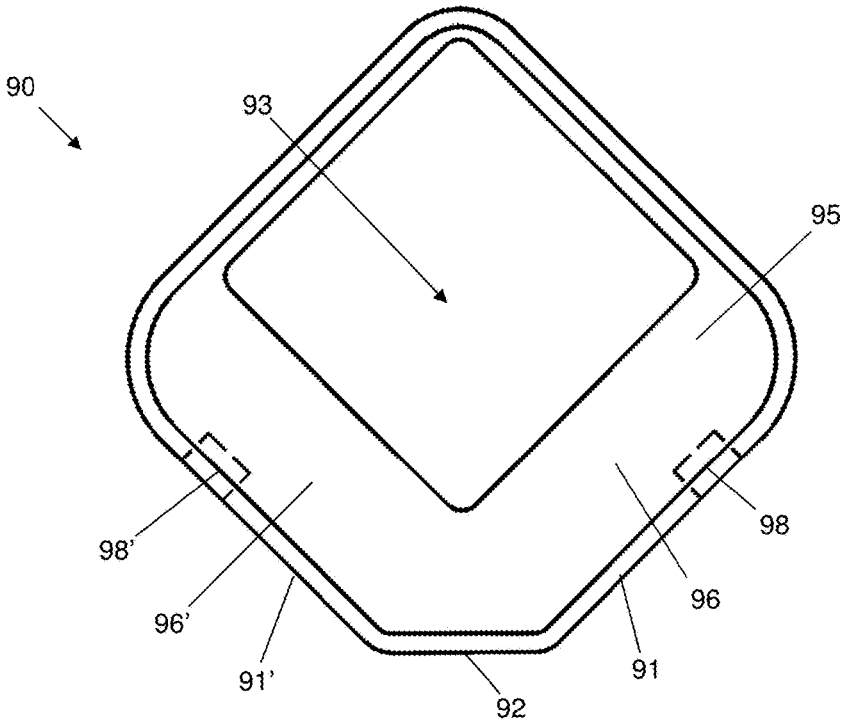

The translational connectors 30 connect the headboard 20 to the frame 10 and permit vertical movement of the frame 10 with respect to the headboard 20 while supporting the headboard 20 in an upright orientation. As shown in FIGS. 2A and 2B, the exemplary translational connectors 30 each comprise a track 31 and a slidable element 37.

As shown in FIG. 2A, the track 31 is a rail-like, longitudinally extended element having a length in a first dimension, a width in a second dimension, and depth in a third dimension. The track 31 defines a groove 32 running along an axis within the first dimension. As shown in FIG. 2B, the groove 32 forms a "T"-shaped configuration comprising a wider cross-sectional portion 33 in a substantially rectangular configuration and a narrower cross-sectional portion 34 in a substantially rectangular configuration. The narrower cross-sectional portion 34 provides an opening to the wider cross-sectional portion 33 of the groove 32. The track 31 further comprises apertures for connecting either to the headboard 20 or the frame 10.

The slidable element 37 comprises a foot 38 and an arm 39 extending therefrom. The foot 38 is configured to fit within the wider cross-sectional portion 33 of the groove 32 and freely permit translational movement in the first dimension of the track 31 while preventing substantial translational movement of the slidable element 37 in the second and third dimensions of the track 31 and also preventing substantial rotation of the slidable element 37 about the first, second, or third dimensions of the track 31. As used herein, "rotation about" a particular dimension refers to rotation about any axis parallel to the dimension. The foot 38 preferably has a cross-sectional shape substantially the same as the wider cross-sectional portion 33 of the groove 32 but has a slightly smaller size to slidingly fit therein. The exemplary foot 38 takes the form of a plate extended in a plane in a first dimension and a second dimension and having a depth in a third dimension. The foot 38 is configured to fit in the groove 32 with the first dimension of the foot 38 aligned with the first dimension of the track 31 and the second dimension of the foot 38 aligned with the second dimension of the track 31. The extension of the foot 38 in the first dimension is preferably equal to or, as with the exemplary foot 38, greater than the extension of the foot 38 in the second dimension. The extension of the foot 38 in its first dimension may be at least about 1.25 times, about 1.5 times, about 2 times, about 2.5 times, about 3 times, about 3.5 times, about 4 times or more the extension of the foot 38 in its second dimension, and is preferably less than about 10 times the extension of the foot 38 in its second dimension. The extension of the foot 38 in its first dimension may be at least about 1 cm, about 2 cm, about 3 cm, about 4 cm, about 5 cm, about 6 cm, about 7 cm, about 8 cm, about 9 cm, about 10 cm, about 11 cm, about 12 cm, about 13 cm, about 14 cm, or about 15 cm, and is preferably less than 1 m. The extension of the foot 38 in its second dimension is slightly narrower than the wider-cross-sectional portion 33 of the groove but wider than the narrower cross-sectional portion 34 of the groove 32. The extension of the foot 38 in its second dimension may be at least about 0.25 cm, about 0.5 cm, about 0.75 cm, about 1 cm, about 1.25 cm, about 1.5 cm, about 1.75 cm, about 2 cm, or about 2.5 cm, and is preferably less than 1 m. For purposes of stabilizing a bed frame, the extension of the foot 38 in its first dimension is preferably greater than about 10 cm, such as about 16 cm, and the extension of the foot 38 in its second dimension is preferably greater than about 1.5 cm, such as about 3 cm.

The arm 39 is configured to connect the foot 38 to a device such as the frame 10 or the headboard 20 via apertures 35 while permitting the foot 38 to slide with respect to the track 31. The exemplary arm 39 takes the form of a plate extended in a plane spanning a first dimension and a third dimension and having a depth in a second dimension, wherein the first, second, and third dimensions of the arm 39 are parallel to the first, second, and third dimensions, respectively, of the foot 38. The extension of the arm 39 in the first dimension is preferably equal to or, as with the exemplary arm 39, greater than the extension of the arm 39 in the second dimension. The extension of the arm 39 in its first dimension may be, throughout its extension in its third dimension, at least about 1.5 times, about 2.5 times, about 5 times, about 7.5 times, about 10 times, about 12.5 times or more the extension of the arm 39 in its second dimension, and is preferably less than about 100 times the extension of the arm 39 in its second dimension. The extension of the arm 39 in its first dimension may be, throughout its extension in its third dimension, at least about 1 cm, about 2 cm, about 3 cm, about 4 cm, about 5 cm, about 6 cm, about 7 cm, or more, and is preferably less than 1 m. The extension of the arm 39 in its second dimension is slightly narrower than the narrower cross-sectional portion 34 of the groove 32. The extension of the arm 39 in its second dimension may be of from about 0.1 cm to about 7 cm. For purposes of stabilizing a bed frame, the dimension of the arm 39 in its first dimension is preferably greater than about 5 cm, such as about 6 cm.

The particular configuration of the foot 38 and the arm 39 and the fit of the foot 38 in the groove 32 of the track 31 are particularly suited for one or more translational connectors 30 to single-handedly support a headboard 20 with respect to a vertically moveable frame 10. When one or more translational connectors 30 are attached to a headboard 20 and frame 10 with the first dimension of the track 31 oriented in the vertical dimension, the substantially form-fitting but slidable fit of the foot 38 within the wider cross-sectional portion 33 of the groove 32 substantially prevents translational and rotational movement of the headboard 20 with respect to the frame 10 in and about all dimensions with the exception of translational movement in the vertical dimension. While in a resting position on the floor, the greatest force in maintaining the headboard 20 in an upright position will typically be a rotational force about the lateral dimension (i.e., a force tending to tilt the headboard 20 toward or away from the frame 10). This force is counteracted by the relatively long extension of both the foot 38 and the arm 39 in their respective first dimensions.

The translational connector 30 can have a number of variations from the exemplary version. In one version, the track 31 can take the form of a bar extended in the first dimension, and the foot 38 can take the form of a sleeve that wraps partially or entirely around the bar in a substantially form-fitting but slidable fit. The bar can have any cross-sectional shape, including circular, elliptical, polygonal, etc. While a single circular bar will permit rotational movement about the vertical dimension, this can be remedied by placement of two or more bars spaced across the lateral dimension. As described above, extension of the foot in the first dimension will counteract rotational forces about the second/lateral dimension. In another version, the track 31 can comprise two grooves on opposite sides of the track 31. The foot 38 can comprise side rails that reach around the front and side of the track 31 and insert into the grooves 32 in a "claw-like" fashion. Again, as described above, extension or spacing of the claws of the foot in the first dimension will counteract rotational forces about the second/lateral dimension. The above variations are only exemplary, and the translational connector 30 can have other variations beyond those explicitly described.

In addition to attaching a headboard 20 to a frame 10, the translational connector 30 of the invention can in the same manner attach a footboard to a frame 10. Using the translation connector 30 in this manner prevents the need to connect the headboard 20 to the footboard other than via the frame 10. Thus, a bed with the translational connectors 30 described herein can have a headboard 20 and a footboard without side boards directly connecting the headboard 20 to the footboard.

An exemplary leg mount cover 50 is shown in FIGS. 3A-3G. The leg mount cover 50 comprises a first side panel 60 connected to a second side panel 60'. The first side panel 60 is oriented substantially orthogonally with respect to the second side panel 60'. As used herein, "oriented substantially orthogonally" or grammatical variants thereof means oriented at an angle of from about 50° and to about 130°, of from about 60° to about 120°, of from about 70° to about 110°, of from about 75° to about 105°, of from about 80° to about 100°, of from about 85° to about 95°, of from about 87° to about 93°, or about 90°. The first and second side panels 60,60' are preferably planar or substantially planar.

Each side panel 60,60' in the exemplary leg mount cover 50 comprises an inner edge 61,61', a top edge 62,62', an outer edge 63,63', a connecting edge 64,64', and a bottom edge 65,65'. Each top edge 62,62' is substantially orthogonal to the inner edge 61,61' on the same panel 60,60'. Each inner edge 61,61' is opposed and substantially parallel to the outer edge 63,63' on the same panel 60,60', and each top edge 62,62' is opposed and substantially parallel to the bottom edge 65,65' on the same panel 60,60'. Each connecting edge 64,64' connects the outer edge 63,63' and the bottom edge 65,65' on the same panel 60,60'. As used herein, "substantially parallel" or grammatical variants thereof means oriented at an angle of from about 0° to about 40°, of from about 0° to about 30°, of from about 0° to about 20°, of from about 0° to about 15°, of from about 0° to about 10°, of from about 0° to about 5°, of from about 0° to about 3°, or about 0°.

Each bottom edge 65,65' in the exemplary leg mount cover 50 is shorter in length than the top edge 62,62' on the same panel 60,60'. In various versions of the invention, each bottom edge 65,65' may have a length no greater than about 0.97, about 0.95, about 0.9, about 0.85, about 0.8, about 0.75, about 0.7, about 0.65, about 0.6, about 0.55, about 0.5, about 0.45, about 0.4, about 0.35, about 0.3, about 0.25, about 0.2, about 0.15, or about 0.1 times the length of the top edge 62,62' on the same panel 60,60', and/or may have a length at least about 0.05, about 0.1, about 0.15, about 0.2, about 0.25, about 0.3, about 0.35, about 0.4, about 0.45, about 0.5, about 0.55, about 0.6, about 0.65, about 0.7, about 0.75, about 0.8, about 0.85, or about 0.9 times the length of the top edge 62,62' on the same panel 60,60'.

Each outer edge 63,63' in the exemplary leg mount cover 50 is shorter in length than the inner edge 61,61' on the same panel 60,60'. In various versions of the invention, each outer edge 63,63' may have a length no greater than about 0.97, about 0.95, about 0.9, about 0.85, about 0.8, about 0.75, about 0.7, about 0.65, about 0.6, about 0.55, about 0.5, about 0.45, about 0.4, about 0.35, about 0.3, about 0.25, about 0.2, about 0.15, or about 0.1 times the length of the inner edge 61,61' on the same panel 60,60', and/or may have a length at least about 0.05, about 0.1, about 0.15, about 0.2, about 0.25, about 0.3, about 0.35, about 0.4, about 0.45, about 0.5, about 0.55, about 0.6, about 0.65, about 0.7, about 0.75, about 0.8, about 0.85, or about 0.9 times the length of the inner edge 61,61' on the same panel 60,60'. Each connecting edge 64,64' is preferably oriented between 0° and 90° with respect to each of the inner edge 61,61' and the top edge 62,62' on the same panel 60,60', such as between about 10° and about 80°, between about 20° and about 70°, and between about 30° and about 60°. The exact angle will depend at least in part on the lengths of the inner edge 61,61', the top edge 62,62', the outer edge 63,63' (if any, see below), and the bottom edge 65,65' (if any, see below).

The side panels 60,60' of the invention may have a number of variations with respect to the exemplary versions shown in the drawings. For example, the side panels 60,60' may have a curvature rather than being planar. The edges 61,61',62,62',63,63',64,64'65,65' may have a curvature rather than being linear. The side panels 60,60' may be devoid of one or both of outer edges 63,63' and bottom edges 65,65', wherein the connecting edges 64,64' connect the top edges 62,62' directly to the inner edges 61,61', connect the top edges 62,62' to the bottom edges 65,65', or connect the outer edges 63,63' to the inner edges 61,61'. The side panels 60,60' may form an "L" bracket-type shape wherein each side panel 60,60' contains two connecting edges 64,64', one substantially parallel to the top edge 62,62' and one substantially parallel to the inner edge 61,61'. The above variations are merely examples, and the side panels 60,60' may have other variations beyond those explicitly described.

The first side panel 60 is connected to the second side panel 60' in the exemplary leg mount cover 50 at the inner edges 61,61' of each panel 60,60' via a spacer panel 80. The spacer panel 80 is a substantially planar panel oriented at about 45° with respect to each of the first side panel 60 and the second side panel 60'. In some versions of the invention, the spacer panel 80 may have a series of smaller connecting segments separated by angles, or may comprise a continuous curvature. In other versions, the spacer panel 80 may be excluded altogether, and the first side panel 60 may connect directly to the second side panel 60'.

Each side panel 60,60' in the exemplary leg mount cover 50 comprises connectors 66,66',67,67' for connecting to a frame, such as a bed frame. The connectors 66,66',67,67' in the exemplary leg mount cover 50 are apertures, which can be used to connect to a frame with a screw, bolt, rivet, hook, or other type of fastener. The connectors 66,66',67,67' may also or alternatively comprise such fasteners. The connectors 66,66',67,67' are preferably disposed in an area between the outer edge 63,63' and the inner edge 61,61', as opposed to an area between the connecting edge 64,64' and the inner edge 61,61'. Other configurations are within the scope of the invention.

In addition to side panels 60,60', the exemplary leg mount cover 50 also includes an upper horizontal panel 70 connected to the side panels 60,60' and oriented substantially orthogonally thereto. For structural support, the upper horizontal panel 70 is preferably connected to the first side panel 60 independently of the second side panel 60' and is also connected to the second side panel 60' independently of the first side panel 60. The upper horizontal panel 70 being connected to the first side panel 60 independently of the second side panel 60' and also being connected to the second side panel 60' independently of the first side panel' means that the upper horizontal panel 70 is connected to the first side panel 60 through at least one series of connections before reaching the second side panel 60' and is also connected to the second side panel 60' through at least one series of connections before reaching the first side panel 60. The exemplary upper horizontal panel 70 is connected to each of the side panels 60,60' via substantially planar spacer panels 81,81' oriented about 45° with respect to each of the upper horizontal panel 70 and the respective side panel 60,60' to which it joins. Spacer panels 81,81' may comprise the same variations described above for spacer panel 80 or may be excluded such that the upper horizontal panel 70 connects directly to each of the side panels 60,60'.

The upper horizontal panel 70 is preferably disposed toward the top of the leg mount cover 50. Specifically, the upper horizontal panel 70 is preferably disposed with respect to the top edge 62,62' at a vertical position within about 0.8 times the vertical length of the inner edges 60,60', such as within about 0.7, 0.6, 0.5, 0.4, 0.3, 0.2, or 0.1 times the vertical length of the inner edges 61,61'. The exemplary upper horizontal panel 70 is disposed above top edges 62,62'. The upper horizontal panel 70 may alternatively be disposed below the top edges 62,62'.

The exemplary upper horizontal panel 70 is formed from two independent flaps 71,71'. A first flap 71 is connected to the first side panel 60 via spacer panel 81, and a second flap 71' is connected to the second side panel 60' via spacer panel 60'. The two flaps 71,71' may be directly connected by welding, adhesive, or other type of connection or may be left unconnected.

The exemplary upper horizontal panel 70 comprises a number of different types of connectors 72,72',73 for connecting to a support leg 110. Apertures 72,72' may be used for connecting the upper horizontal panel 70 to the top of a support leg 110 with fasteners such as screws, bolts, rivets, etc. A tang comprising a tang aperture 74 may be used in a clevis assembly. The tang may be formed from separate tang flaps 73,73' emerging from flaps 71,71', respectively, that are folded downward from flaps 71,71' to be substantially parallel to each other and, optionally, connected through welding, adhesive, or other type of connection. Other connectors are suitable for including on the upper horizontal panel 70.

The exemplary leg mount cover 50 also includes one or more lower horizontal panels 76,76' connected to one or more of the side panels 60,60' and oriented substantially orthogonally thereto. The lower horizontal panels 76,76' form platforms for supporting the stabilizer blocks 80,90, as described in further detail below. The lower horizontal panels 76,76' are preferably disposed beneath the upper horizontal panel toward the bottom of the leg mount cover 50. The exemplary lower horizontal panels 76,76' extend from the bottom edges 65,65' of the first and second side panels 60,60'. Each lower horizontal panel 76,76' preferably extends from the side panel 60'60' from which it is directly connected no more than a distance of about 0.8, about 0.75, about 0.7, about 0.65, about 0.6, about 0.55, about 0.5, about 0.4, about 0.35, about 0.3, about 0.25, about 0.2, about 0.15, about 0.1, or about 0.05 times a furthest distance the upper horizontal panel extends from the same panel. See, e.g., FIG. 3F. Such a configuration permits clearance for a support leg 110 connected to the upper horizontal panel and running through a stabilizer block disposed on the lower horizontal panels 76,76', as described in further detail below.

The exemplary leg mount cover 50 also includes a connecting-edge panel 84,84' attached to the connecting edge 64,64' of each side panel 60,60'. The connecting-edge panels 84,84' extend from the connecting edges 64,64' at an angle with respect to the side panels 60,60'. The connecting-edge panels 84,84' provide a rounded or blunted edge at connecting edge 64,64' by providing a surface area greater than the depth of the side panels 60,60' themselves. The connecting-edge panels 84,84' extend from the connecting edges 64,64' at an angle of at least about 1°, about 10°, about 20°, about 30°, about 40°, about 50°, about 60°, about 70°, about 80°, about 90°, about 100°, about 110°, about 120°, about 130°, about 140°, about 150°, about 160°, about 180°, about 190° about 200° or more. Angles greater than about 90° are preferred to hide any sharp edges from potential exposure. Angles greater than about 180° can be accomplished due to the curvature of the material and extension of the material in a direction orthogonal to the side panels 60,60' as it emerges from the connecting edge 64,64'. The connecting edges 64,64' preferably span at least about 10%, about 15%, about 20%, about 25%, about 30%, about 35%, about 40%, about 45%, about 50%, about 55%, about 60%, about 65%, about 70%, about 75%, about 80%, about 85%, about 90%, about 95%, or more of the length of the connecting edge 64,64'.

In various versions of the invention, the leg mount cover 50 may be formed from a single piece of material that is folded, bent, or angled to form any or all of the side panels 60,60', upper horizontal panel 70, lower horizontal panels 76,76', spacer panels 80,81,81', tang flaps 73,73', and connecting-edge panels 84,84'. In the exemplary leg mount cover 50, each of the side panels 60,60', upper horizontal panel 70, lower horizontal panels 76,76', spacer panels 80,81,81', tang flaps 73,73', and connecting-edge panels 84,84' are formed from a single piece of material without welding, adhering or otherwise attaching separate pieces thereto. Gaps 77,78 are formed in this manner. Flap 71 and flap 71' are welded together in the exemplary leg mount cover 50, but this constitutes welding a single piece of material to itself, not welding two separate pieces of material to each other. Such a configuration aids in simplifying the manufacture of the leg mount cover 50. The leg mount cover 50 may be made from metal, plastic, carbon fiber, or other solid materials.

Figure 6A:
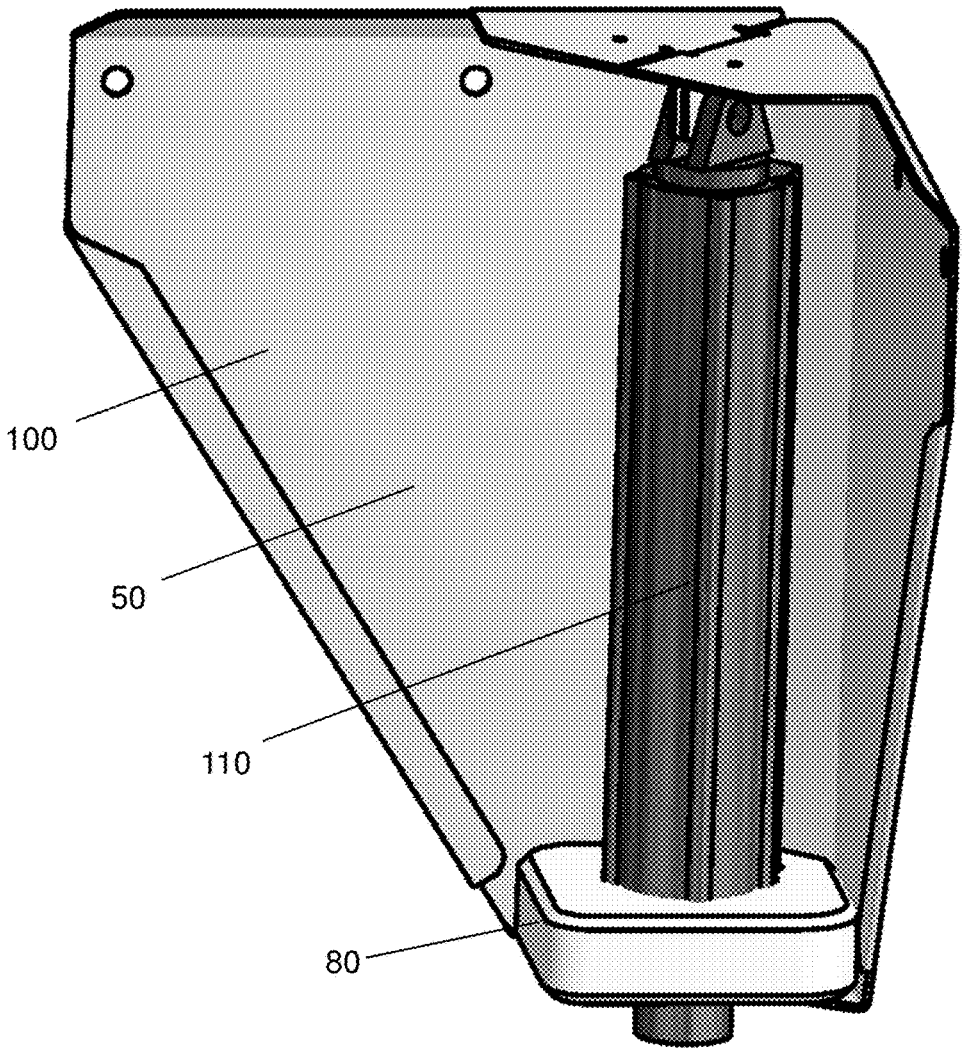
FIGS. 6A-6C show various views of an exemplary leg mount of the present invention with support legs mounted therein.
Figure 6B:
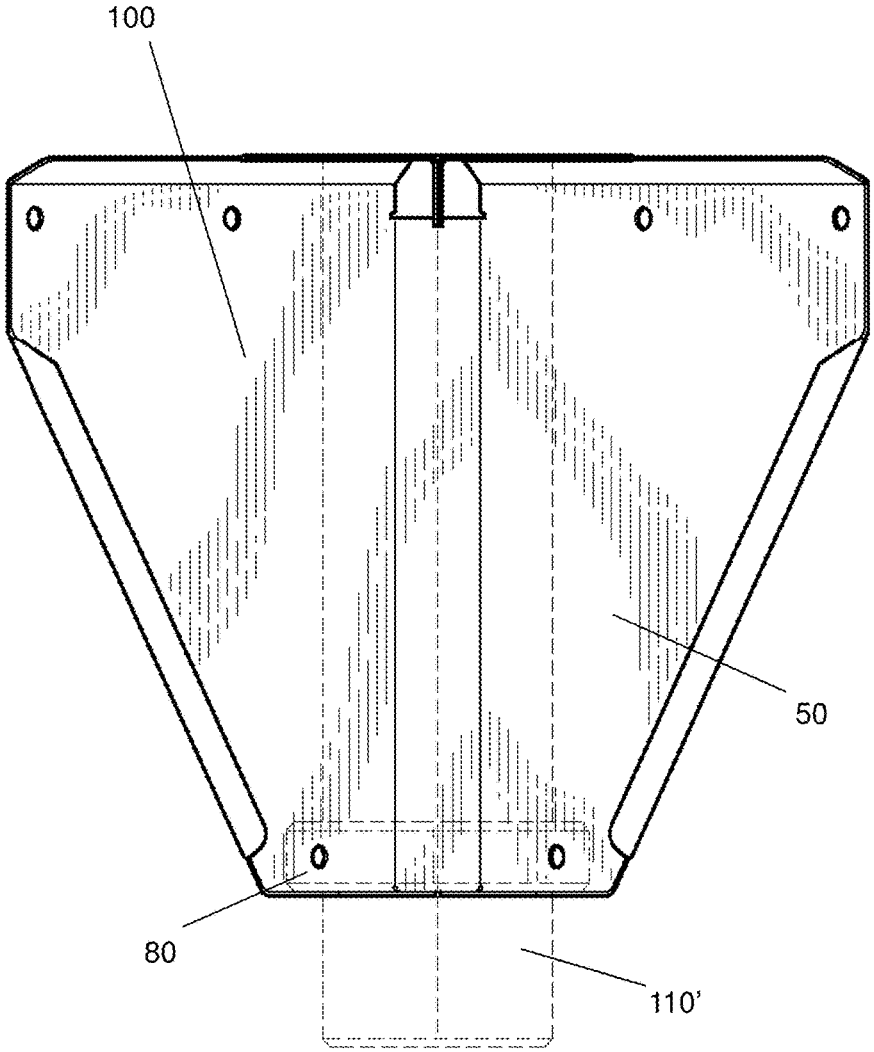

Exemplary stabilizer blocks 80,90 are shown in FIGS. 4A-4C and 5A-5B. The stabilizer blocks 80,90 are solid blocks, each comprising a height, a width, and a depth. The stabilizer blocks 80,90 are configured to connect to the leg mount cover 50 in a nested configuration, as shown in FIGS. 6A-6B.

The exemplary stabilizer blocks 80,90 each comprise a first side surface 81,91, a second side surface 81',91' oriented substantially orthogonally with respect to the first side surface 81,91, and a spacer side surface 82,92 between the first side surface 81,91 and the second side surface 81',91' and oriented at about a 45 degree angle with respect to each of the first side surface 81,91 and the second side surface 81',91'. These surfaces 81,91,81',91',82,92 are configured such that at least the first side surface 81,91 and the second side surface 81',91' can simultaneously contact the first side panel 60 and the second side panel 60', respectively, of the leg mount cover 50. In some versions, the surfaces 81,91, 81',91',82,92 are configured such that each of the first side surface 81,91, the second side surface 81',91', and the spacer side surface 82,92 can simultaneously contact the first side panel 60, the spacer panel 80, and the second side panel 60', respectively, of the leg mount cover 50.

The exemplary stabilizer blocks 80,90 each comprise a channel 83,93 running therethrough from a top surface 84,94, to a bottom surface 85,95. The channels 83,93, each define a cross-sectional shape to accommodate at least a portion of a support leg 110 therein, preferably in a substantially form-fitting configuration without substantial gaps between the stabilizer block 80,90 and the support leg 110. In some versions, such as the stabilizer block 90 shown in FIGS. 4A-4C, the channel 83 may define various horizontal or non-vertical support ledges 87 to contact and support various corresponding portions of a support leg 110. The bottom surfaces 85,95 of the exemplary stabilizer blocks 80,90 each comprise support portions 86,86',96,96' configured to provide a contact surface for contacting against the lower horizontal panels 76,76' of the leg mount cover 50. Positioning of the channels 83,93 from each the first side surfaces 81,91 and the second side surfaces 81',91' at a distance at least as great as the distance the lower horizontal panels 76,76' extend from the first side surface 60 and the second side surface 60' provides sufficiently large support portions 86,86',96,96' for the lower horizontal panels 76,76' to contact the support portions 86,86',96,96' without extending into the channels 83,93.

The exemplary stabilizer blocks 80,90 each comprise connectors 88,88',98,98' positioned to be in register with corresponding connectors 68,68' on the leg mount cover 50 when the stabilizer block 80,90 is nested against the leg mount cover and supported on the support portions 86,86', 96,96'. The exemplary connectors 88,88',98,98' on the stabilizer blocks 80,90 may comprise threaded apertures, and the exemplary connectors 68,68' on the leg mount cover 50 may comprise non-threaded apertures. The leg mount cover 50 can be reversibly connected to the stabilizer block 80,90 by passing fasters, such as threaded bolts, through the connectors 68,68' on the leg mount cover 50 and screwing into the connectors 88,88',98,98' on the stabilizer blocks 80,90.

Figure 6C:
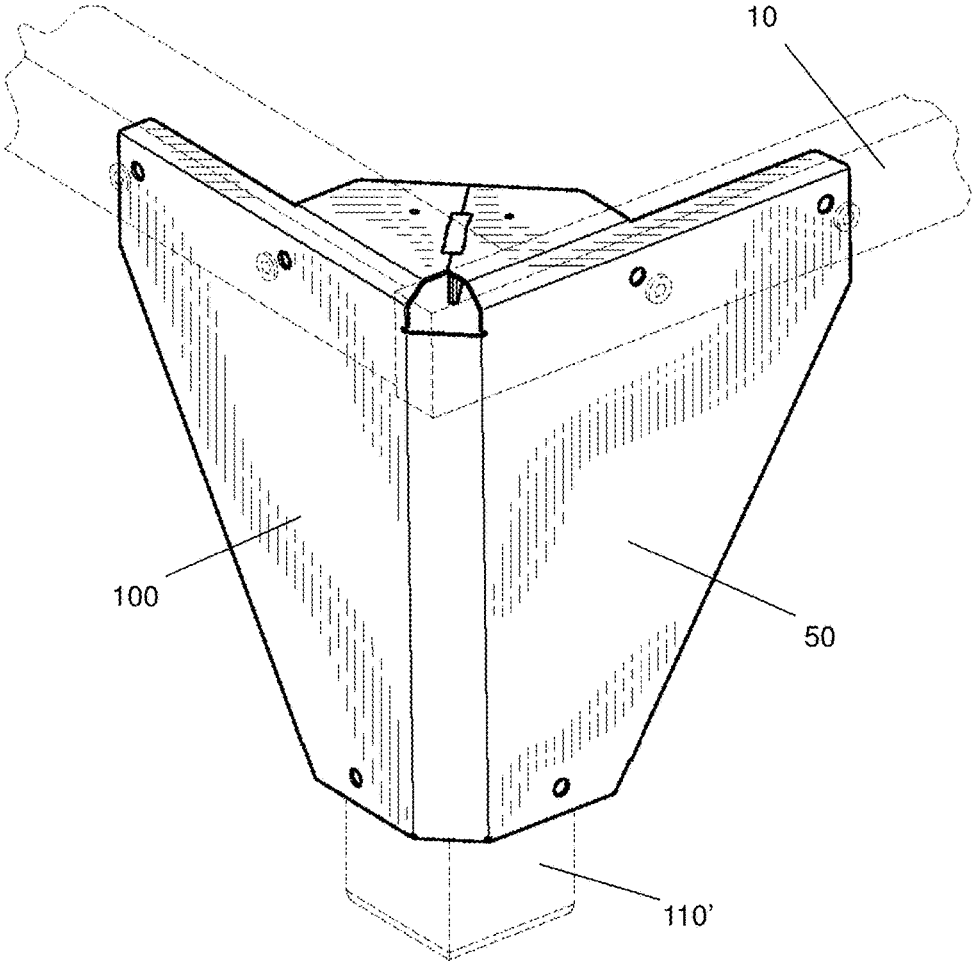

An exemplary leg mount 100 with exemplary support legs 110, 110' are shown in FIGS. 6A-6C. The leg mount 100 comprises the leg mount cover 50 and exemplary stabilizer block 80 connected thereto in a nested configuration. The first side surface 81 the second side surface 81', and the spacer side surface 82 of the stabilizer block 80 is in contact with the first side panel 60, the spacer panel 80, and the second side panel 60', respectively, of the leg mount cover 50; the support portions 86,86' of the stabilizer block 80 are in contact with the lower horizontal panels 76,76' of the leg mount cover 50; and the stabilizer block 80 is attached to the leg mount cover 50 via connectors 68,68',88,88'.

The support legs 110,110' are attached to the upper horizontal panel 70 via the tang in a clevis assembly or via apertures 72,72' in the upper horizontal panel 70, extend lengthwise along a line substantially orthogonal to the upper horizontal panel 70 through the stabilizer block 80, and nest within the stabilizer block 80. The upper horizontal panel 70 provides a vertical counterforce against the support legs 110,110' when the support legs 110,110' are placed on the ground, and the stabilizer block 80 maintains the support legs 110,110' in a substantially vertical orientation.

The removability of the stabilizer blocks 80,90 from the leg mount cover 50 and the multitude of stabilizer blocks 80,90 having differently configured channels 83,93 permits the interchangeability of different support legs 110,110' with a variety of shapes, sizes, and functions in the same leg mount cover 50. For example, the exemplary support leg 110 shown FIG. 6A is an extendable support leg having an extendable portion protruding through the stabilizer block 80. This support leg 110 can be exchanged with a non-extendable support leg 110' having a different size, cross-sectional shape, and/or surface configuration, as shown in FIGS. 6B and 6C, by removing the stabilizer block 80 shown in FIGS. 4A-4C and exchanging it, for example, with the stabilizer block 90 shown in FIGS. 5A-5B. The support legs 110,110' can be exchanged without removing the leg mount cover 50 from the frame 10 to which it is attached. The invention thus provides for the interchangeability of any of a variety of support legs having different shapes, sizes, and/or functions.

The leg mounts 100 described herein can be used on any piece of furniture or appliance resting on a solid support surface, including end tables, chairs, couches, dressers, bed stands, refrigerators, ovens, microwaves, etc. Thus, "floor" is used broadly herein to refer to any solid support surface.

The elements and method steps described herein can be used in any combination whether explicitly described or not.

All combinations of method steps as used herein can be performed in any order, unless otherwise specified or clearly implied to the contrary by the context in which the referenced combination is made.

As used herein, the singular forms "a," "an," and "the" include plural referents unless the content clearly dictates otherwise.

Numerical ranges as used herein are intended to include every number and subset of numbers contained within that range, whether specifically disclosed or not. Further, these numerical ranges should be construed as providing support for a claim directed to any number or subset of numbers in that range. For example, a disclosure of from 1 to 10 should be construed as supporting a range of from 2 to 8, from 3 to 7, from 5 to 6, from 1 to 9, from 3.6 to 4.6, from 3.5 to 9.9, and so forth.

Numerical parameters above and below those explicitly disclosed herein are encompassed by the scope of the present invention unless the content clearly dictates otherwise.

All patents, patent publications, and peer-reviewed publications (i.e., "references") cited herein are expressly incorporated by reference to the same extent as if each individual reference were specifically and individually indicated as being incorporated by reference. In case of conflict between the present disclosure and the incorporated references, the present disclosure controls.

It is understood that the invention is not confined to the particular construction and arrangement of parts herein illustrated and described, but embraces such modified forms thereof as come within the scope of the claims.

What is claimed is:

1. A leg mount comprising: a leg mount cover, the leg mount cover comprising: a first side panel; a second side panel connected to the first side panel and oriented substantially orthogonally with respect to the first side panel; and an upper horizontal panel oriented substantially orthogonally with respect to both the first side panel and the second side panel, connected to the first side panel independently of the second side panel, and connected to the second side panel independently of the first side panel; and an at least one stabilizer block removably affixable to the leg mount cover via the first side panel and the second side panel, the at least one stabilizer block comprising a channel running therethrough, wherein the channel is positioned with respect to the upper horizontal panel when the at least one stabilizer block is affixed to the leg mount cover such that a support leg running lengthwise along a line substantially orthogonal to the upper horizontal panel can extend through the channel; wherein the leg mount cover further comprises spacer panels disposed between the first side panel and the second side panel and between the top panel and each of the first side panel and second side panel.

2. The leg mount of claim 1, wherein each of the first side panel and the second side panel comprises a top edge, a bottom edge, and an inner edge, wherein the first side panel is connected to the second side panel via the respective inner edges, and wherein a length of each bottom edge is no greater than 0.8 times a length of the top edge on the same panel.

3. The leg mount of claim 1, wherein each of the first side panel and the second side panel comprises a top edge, an inner edge, and a connecting edge, wherein the first side panel is connected to the second side panel via the respective inner edges, and wherein the connecting edge is oriented between 0° and 90° with respect to each of the top edge and the inner edge.

4. The leg mount of claim 3 wherein each of the first side panel and the second side panel comprises a connecting-edge panel folded from each of the first side panel and the second side panel at the connecting edge on each panel at an angle of at least about 90° with respect to the respective first side panel and second side panel.

5. The leg mount of claim 1, wherein:

each of the first side panel and the second side panel comprises a top edge, a bottom edge, an inner edge, an outer edge, and a connecting edge;

the first side panel is connected to the second side panel via the respective inner edges;

each bottom edge opposes the top edge on the same panel, is substantially parallel to the top edge on the same panel, and has a length no greater than about 0.8 times a length of the top edge on the same panel;

each outer edge opposes the inner edge on the same panel, is substantially parallel to the inner edge on the same panel, and has a length no greater than about 0.8 times a length of the inner edge on the same panel; and each connecting edge spans from the outer edge to the bottom edge on the same panel.

6. The leg mount of claim 1, wherein the leg mount cover further comprises a lower horizontal panel, the lower horizontal panel oriented substantially orthogonally with respect to both the first side panel and the second side panel and extending from the first side panel or the second side panel no further than a distance about 0.75 times a furthest distance the upper horizontal panel extends from the same panel.

7. The leg mount of claim 1, wherein the first side panel, the second side panel, and the upper horizontal panel are all formed by a single piece of folded material.

8. The leg mount of claim 1, wherein the at least one stabilizer block comprises a first surface and a second surface, wherein the first surface abuts the first side panel and the second surface abuts the second side panel when the at least one stabilizer block is affixed to the leg mount cover.

9. The leg mount of claim 1, wherein the leg mount cover further comprises a lower horizontal panel, the lower horizontal panel oriented substantially orthogonally with respect to both the first side panel and the second side panel and extending from the first side panel or the second side panel no further than a distance about 0.75 times a furthest distance the upper horizontal panel extends from the same panel, and wherein the at least one stabilizer block comprises a horizontal surface that abuts the lower horizontal panel when the at least one stabilizer block is affixed to the leg mount cover.

10. The leg mount of claim 1, wherein the at least one stabilizer block comprises a plurality of stabilizer blocks, wherein the channel of at least one of the plurality of stabilizer blocks differs from the channel of another of the plurality of stabilizer blocks by a characteristic selected from the group consisting of size and shape.

* * * * *